US011333457B1

(12) United States Patent
DeVoe

(10) Patent No.: US 11,333,457 B1
(45) Date of Patent: May 17, 2022

(54) SAFETY DEVICE FOR IMPROVED RIFLE DRY FIRE PRACTICE

(71) Applicant: Alexander F. DeVoe, Caledonia, MI (US)

(72) Inventor: Alexander F. DeVoe, Caledonia, MI (US)

( * ) Notice: Subject to any disclaimer, the term of this patent is extended or adjusted under 35 U.S.C. 154(b) by 0 days.

(21) Appl. No.: 17/483,918

(22) Filed: Sep. 24, 2021

(51) Int. Cl.
*F41A 17/74* (2006.01)
*F41A 17/76* (2006.01)
*F41A 33/00* (2006.01)
*F41A 3/66* (2006.01)

(52) U.S. Cl.
CPC ..... *F41A 17/76* (2013.01); *F41A 3/66* (2013.01); *F41A 33/00* (2013.01)

(58) Field of Classification Search
CPC ..... F41A 17/76; F41A 17/44; F41A 17/34; F41A 3/66; F41A 33/00; F41A 33/02; F41A 35/00; F41A 9/65; F42B 8/02; F42B 8/08
USPC ..... 102/444; 42/70.01, 70.02, 70.08, 70.11, 42/96, 106; 89/29
See application file for complete search history.

(56) References Cited

U.S. PATENT DOCUMENTS 4,726,136 A * 2/1988 Dornaus ..... F41A 9/53 42/7
5,208,406 A * 5/1993 Badali ..... F41A 17/74 42/70.08
5,251,394 A * 10/1993 Bornancini ..... F41A 17/56 42/70.05
5,560,132 A * 10/1996 Merlino ..... F41A 17/74 42/66
6,543,170 B2 * 4/2003 Beretta ..... F41A 17/74 42/70.08
2010/0170132 A1 * 7/2010 Zukowski ..... F41A 17/66 42/70.08
2015/0198404 A1 * 7/2015 Campbell ..... F41A 33/00 42/70.11
2015/0330734 A1 * 11/2015 Kolev ..... F41A 3/72 42/69.01
2016/0084601 A1 * 3/2016 Alicea, Jr. ..... F41A 17/20 42/6
2021/0033364 A1 * 2/2021 Mather ..... F41A 17/72
2021/0080212 A1 * 3/2021 Alber ..... F41A 3/50
2021/0080221 A1 * 3/2021 Alber ..... F41A 17/36

* cited by examiner

*Primary Examiner* — Michael D David
(74) *Attorney, Agent, or Firm* — Gardner, Linn, Burkhart & Ondersma LLP

(57) ABSTRACT

A method for inserting a safety block into a rifle comprising an upper receiver and a lower receiver, the lower receiver comprising a trigger assembly positioned within a cavity. The method includes separating the upper receiver and the lower receiver to expose the lower receiver and inserting the safety block into the cavity. The safety block comprises a hammer cavity configured to surround the trigger assembly such that the safety block surrounds at least a hammer of the trigger assembly. A hammer stop of the safety block is configured to rest against the hammer. The method includes closing the upper receiver against the lower receiver. Closing the upper receiver brings the upper receiver into contact with the safety block and rotationally pushes the hammer stop of the safety block forward and against the hammer. Rotating the safety block against the hammer rotates the hammer such that the hammer is freed from a restraining portion of the trigger assembly.

13 Claims, 13 Drawing Sheets

(VIEW FROM THE LEFT SIDE)

(VIEW FROM THE BACK)

(VIEW FROM THE LEFT SIDE)

(VIEW FROM THE BACK)

FIG. 4A

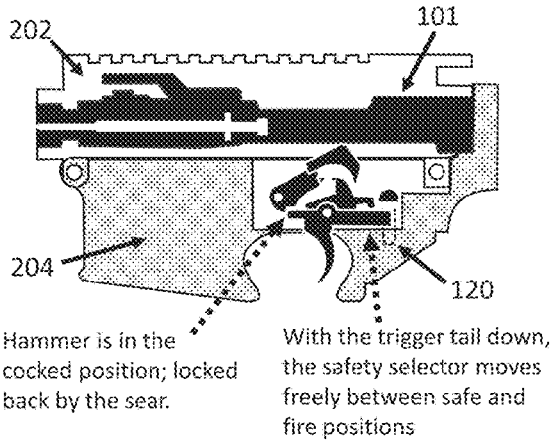

FIG. 4B

The trigger is pulled and the hammer strikes the pin. Without live ammo to cycle the action, the hammer stays in this position.

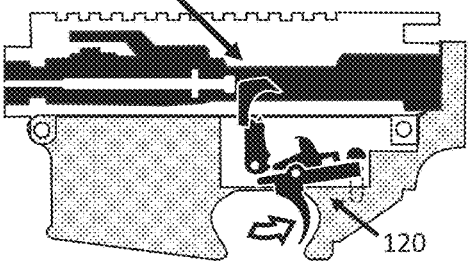

FIG. 4C

The hammer locks the trigger in this position. The trigger is unable to reset and will lock the safety in the fire position.

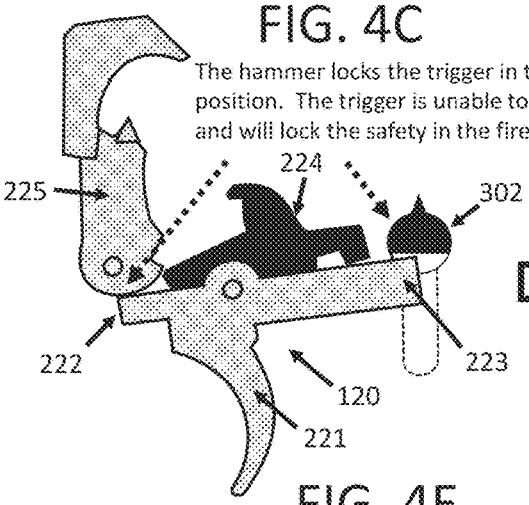

FIG. 4D

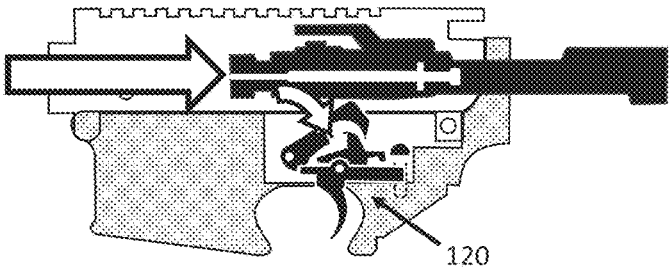

The operator must pause live fire training momentarily to rack the charging handle in order for the BCG to lock the hammer back into the cocked position.

FIG. 4E

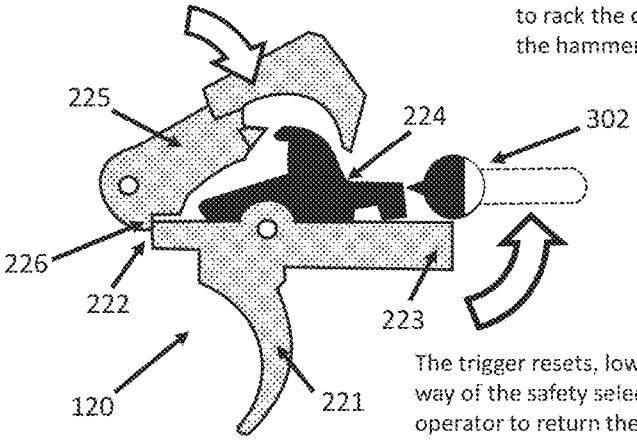

The trigger resets, lowering the tail out of the way of the safety selector switch allowing the operator to return the weapon to safe.

FIG. 8A
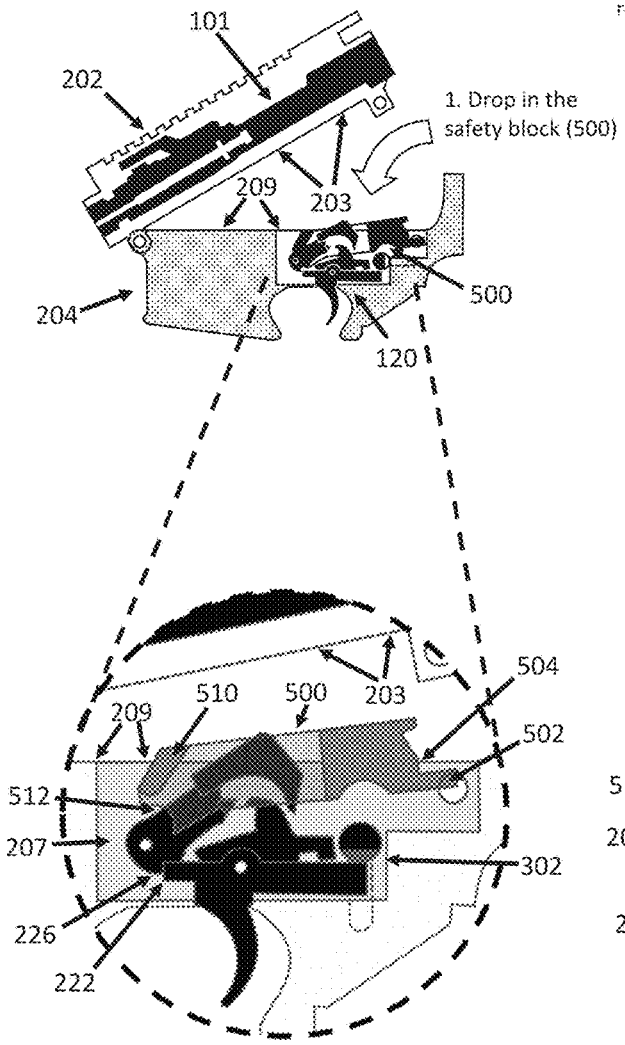
FIG. 8B
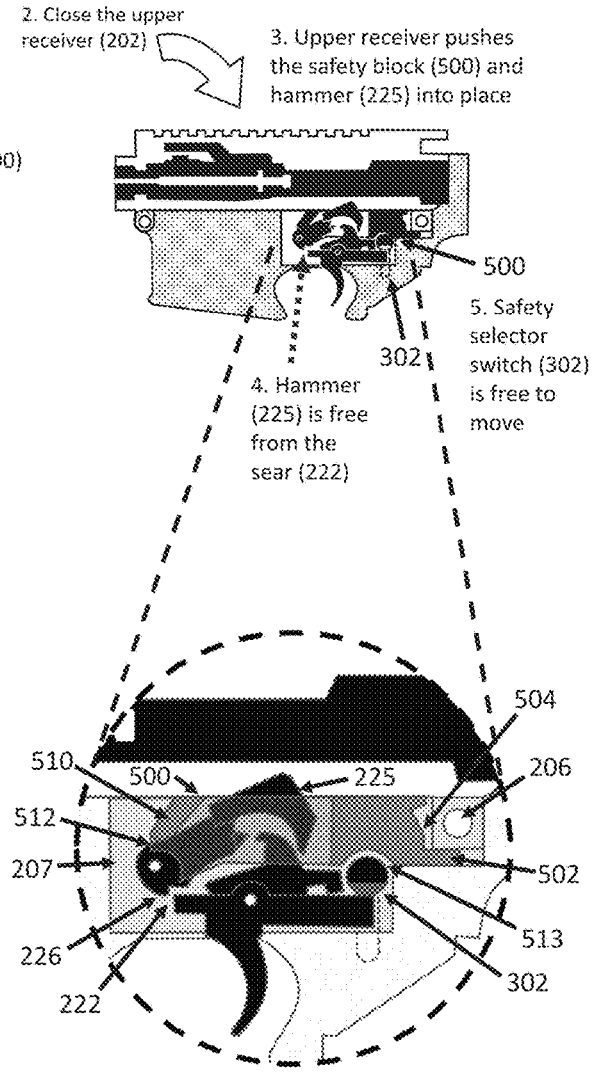
FIG. 8C
FIG. 8D

FIG. 12A
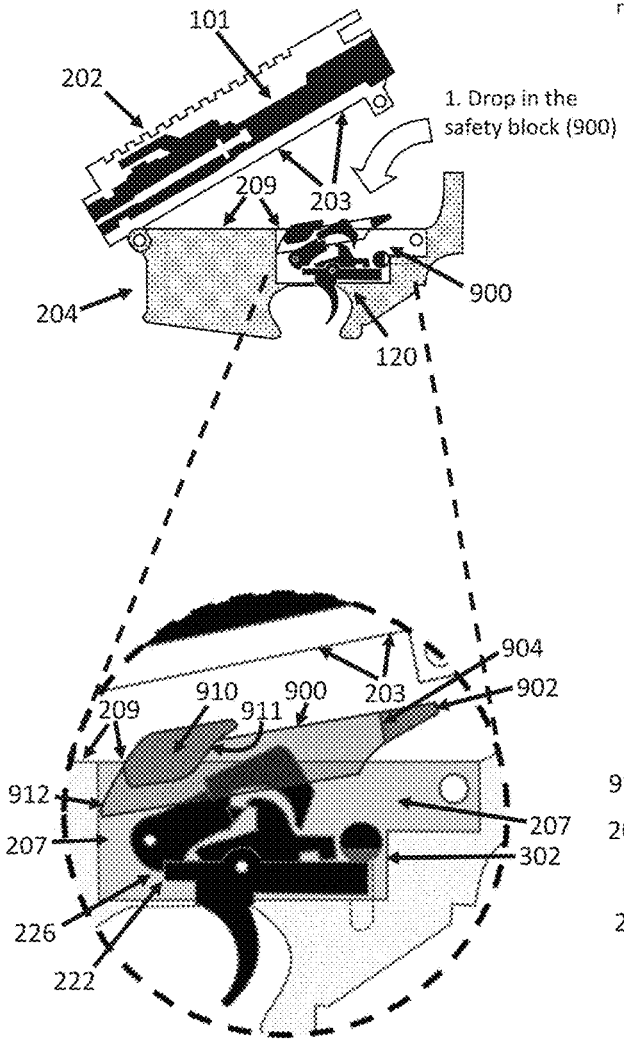
FIG. 12B
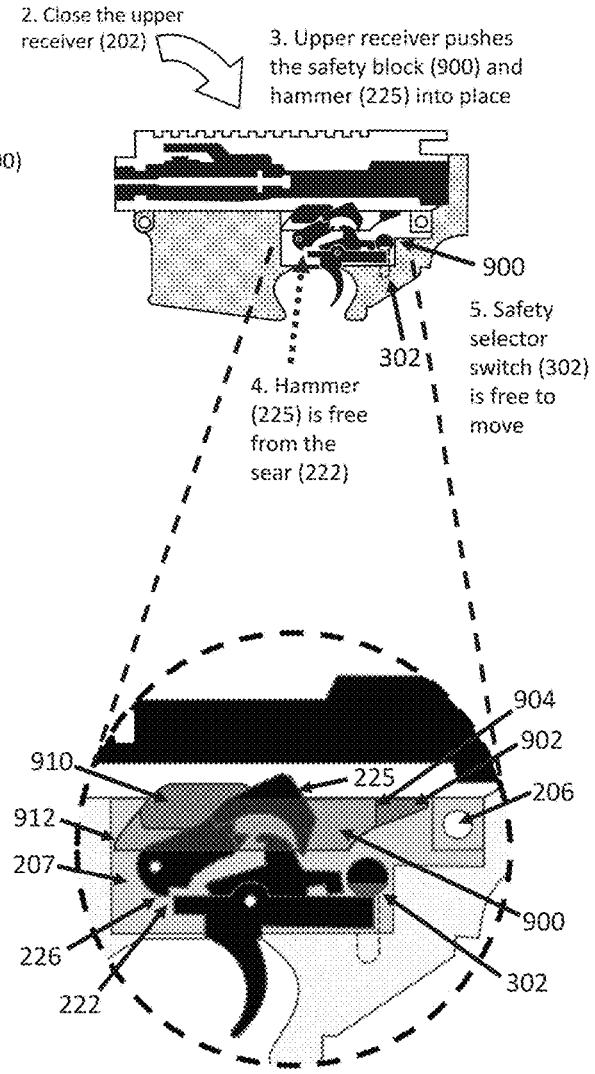
FIG. 12C
FIG. 12D

Standard Single Stage

Drop-In Single Stage

Standard Two Stage

Drop-In Two Stage

SAFETY DEVICE FOR IMPROVED RIFLE DRY FIRE PRACTICE

FIELD OF THE INVENTION

The present invention is directed to firearms, and in particular, to firearms with safeties that lock both the trigger and the sear.

BACKGROUND OF THE INVENTION

The conventional AR-platform, which is based on the original ArmaLite AR-10/AR-15 designs, is a popular rifle platform. In 2018, the National Shooting Sports Foundation (NSSF), estimated there were between 5-10 million AR-15 style rifles in circulation within the military, law enforcement, and civilian communities, while further finding nearly 20 million modern sporting rifles in circulation, used for hunting, competition, and self-defense. Whether in the military, law enforcement, competition shooting, hunting, home defense, or just a hobbyist, proficiency in using any firearm cannot be understated. Training is a must to ensure safety, accuracy, and speed. It is commonly understood that a majority of the training for any firearm is accomplished off the range and without live ammunition. Many hours of training are necessarily spent practicing the various movements associated with operating the firearm. Such "dry fire" training and repeat operation of the firearm's controls is essential to develop the needed muscle memory.

However, the AR platform (examples include but are not limited to: AR-15, M-16, and M-4 rifles) has a unique challenge during such dry fire sessions. Without live ammunition to cycle the rifle's mechanism, once the trigger is pulled, the AR-15 rifle's safety selector switch is locked in the fire position until the hammer is re-cocked. This is because the trigger and the sear are one solid piece (in most other semiautomatic rifles the trigger and sear are separate and the safety only locks the trigger). In real-world situations, this design makes the AR safety selector extremely safe and effective. However, during dry fire drills, it is more difficult to practice proper positioning of the safety when bringing the rifle to and from a target. An operator must pause the drill to reset the trigger by charging the bolt any time the trigger is pulled to allow for continued manipulation of the safety switch.

SUMMARY OF THE INVENTION

An exemplary safety device of the present invention is configured as an insert or block for mounting between an AR platform rifle's upper receiver and lower receiver. A trigger assembly is situated in the lower receiver. The trigger assembly comprises a trigger and a hammer. The safety block is configured for insertion into the lower receiver and to surround an upper portion of the hammer. The safety block includes a hammer stop configured to conform to an outer surface of the hammer and when moved into position, rotates the hammer away from a sear of the trigger, such that a hammer cocking notch of the hammer is freed from the sear and the trigger can be actuated without releasing the hammer. With the hammer held in this position and freed of the sear, the trigger can be repeatedly pulled while dry firing and a safety selector switch repeatedly switched between "safe" and "fire" without the need to reset the trigger assembly.

An exemplary safety block of the present invention is configured for insertion into a rifle comprising an upper receiver and a lower receiver, the lower receiver comprising a trigger assembly positioned within a cavity of the lower receiver. The safety block is a body comprising: a hammer cavity extending through a central portion of the body from a top surface of the body to a bottom surface of the body; and a hammer stop configured to rest against a hammer of the trigger assembly when the safety block is inserted into the rifle. The safety block includes a forward portion formed from the body and configured to contact a forward edge of the lower receiver cavity when the safety block is inserted into the rifle, and a rear portion formed from the body and configured to contact a rear edge of the cavity when the safety block is inserted into the rifle. The body is configured to contact at least two sides of the lower receiver cavity when the safety block is inserted into the rifle. The hammer stop of the body is configured to rotate forward and rotationally push against the hammer when the upper receiver is closed against the lower receiver, such that the safety block is forced into the lower receiver cavity. The hammer stop is configured to rotate the hammer such that the hammer is freed from a restraining portion of the trigger assembly when the safety block is forced into the lower receiver cavity.

In an aspect of the present invention, a method for inserting a safety block into a rifle which comprises an upper receiver and a lower receiver, the lower receiver comprising a trigger assembly positioned within a cavity of the lower receiver, with the method including separating the upper receiver and the lower receiver to expose the lower receiver and inserting the safety block into the lower receiver cavity. The safety block comprises a hammer cavity configured to surround the trigger assembly such that the safety block surrounds at least a hammer of the trigger assembly. A hammer stop of the safety block is configured to rest against an upper surface of the hammer. The method includes closing the upper receiver against the lower receiver. Closing the upper receiver brings the upper receiver into contact with the safety block and rotationally pushes the safety block forward and against the hammer. Rotating the safety block against the hammer rotates the hammer such that the hammer is freed from a restraining portion of the trigger assembly when the safety block is forced into the lower receiver cavity.

In another aspect of the present invention, the hammer stop of the safety block is configured to contact the hammer at a desired angle such that when the upper receiver pushes the safety block down, the hammer stop is pushed against the hammer and rotationally pushes the hammer enough to free the hammer from the restraining portion of the trigger assembly.

In yet another aspect of the present invention, the safety block is configured to contact at least two sides of the lower receiver cavity to hold the safety block securely in position with respect to the trigger assembly and the hammer stop.

In a further aspect of the present invention, a forward portion of the safety block contacts a forward portion of the lower receiver cavity, and a rear portion of the safety block contacts a rear portion of the lower receiver cavity when the upper receiver is closed against the lower receiver.

In an aspect of the present invention, the rear portion of the safety block is configured to contact an upper receiver takedown pin catch. A portion of the rear portion of the safety block is under the upper receiver takedown pin catch. The forward portion of the safety block comprises a pull tab configured to aid in removal of the safety block from the lower receiver when the upper receiver is opened.

In yet another aspect of the present invention, the hammer opening is configured such that the trigger assembly does not contact any portion of the hammer opening. Furthermore, the hammer opening of the safety block is configured such that while the hammer stop holds the hammer in a desired position, other portions of the trigger assembly are free to operate without interference from the safety block. Furthermore, the safety block is completely free of the bolt carrier group (BCG), chamber, magazine, magazine well, and other components of the action, allowing for the use of dummy/inert rounds during dry fire/training sessions.

In a further aspect of the present invention, while the hammer is held in the desired position, a safety selector switch of the rifle can be freely rotated from safe to fire positions without interference from the trigger assembly. Pulling back on a trigger of the trigger assembly, which rotates the restraining portion away from the hammer, does not lock the safety selector switch in the fire position.

Thus, with the safety block inserted into the cavity of the lower receiver, when the upper receiver is closed over the lower receiver, the safety block rotationally pushes (via the hammer stop) the hammer back and away from the sear and the disconnector. While the safety block holds the hammer free of the sear, free manipulation is provided of the safety switch and trigger in any dry fire or training setting.

Additionally, with the safety block inserted into the cavity of the lower receiver, when the upper receiver is closed over the lower receiver, dummy rounds can be used without restriction from the safety block. Furthermore, with the safety block installed, the weapon will not fire live rounds.

These and other objects, advantages, purposes and features of the present invention will become apparent upon review of the following specification in conjunction with the drawings.

BRIEF DESCRIPTION OF DRAWINGS

FIGS. 4A-4E are a series of left-side cross sectional views of a portion of the AR-platform of FIG. 1 illustrating the operation of the trigger assembly, bolt carrier group, and safety selector;

FIGS. 8A and 8B are right-side views of a portion of the AR-platform rifle of FIG. 1 illustrating the insertion and positioning of the safety device of FIG. 5 in accordance with an embodiment of the present invention;

FIGS. 8C and 8D are inset views of respective portions of FIGS. 8A and 8B in accordance with an embodiment of the present invention;

FIGS. 12A and 12B are right-side views of a portion of the AR-platform rifle of FIG. 1 illustrating the insertion and positioning of the alternative safety device of FIG. 9 in accordance with an embodiment of the present invention;

FIGS. 12C and 12D are inset views of respective portions of FIGS. 12A and 12B in accordance with an embodiment of the present invention;

DETAILED DESCRIPTION OF THE PREFERRED EMBODIMENTS

Figure 1:
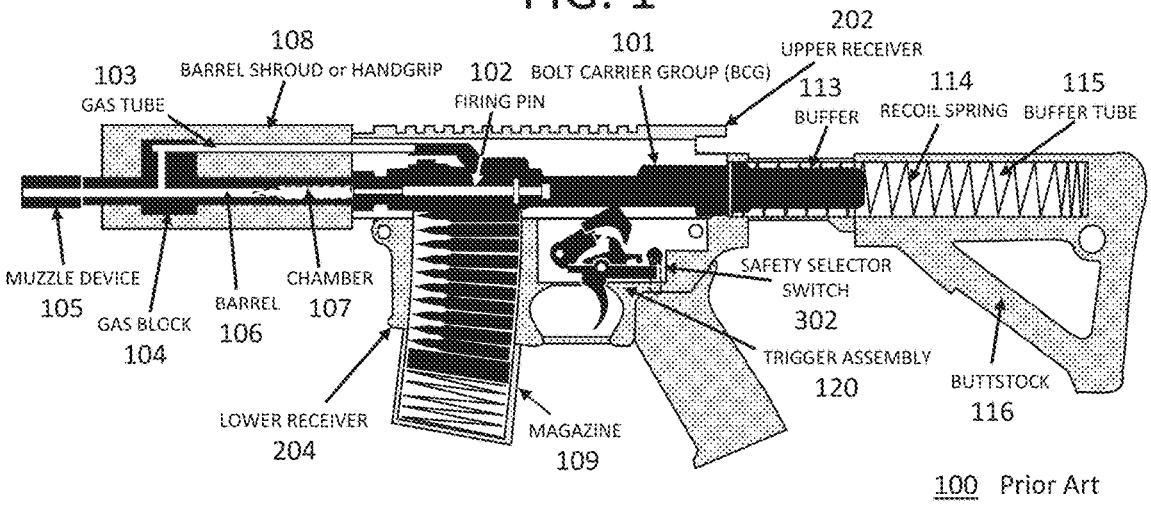
FIG. 1 is a left-side cross sectional view of an AR-platform rifle.

Referring now to the drawings and the illustrative embodiments depicted therein, an exemplary safety block, device, fixture, or insert (hereinafter a "safety block"), is configured for insertion into a lower receiver of an AR-platform rifle, such that when the upper receiver of the AR-platform rifle is closed over the lower receiver, the safety block slides over the hammer and a portion of the safety block rests against the hammer and forces the hammer to rotate clockwise (as viewed from the left side), such that the hammer backs away from a trigger sear of the AR-platform rifle. With the hammer held in a position away from the trigger sear, the AR-platform rifle's safety selector switch is free to engage and disengage at any time during dry fire training without the need to reset the trigger assembly. Additionally, the AR-platform rifle's "action" is free to operate, allowing an operator to incorporate dummy rounds into a dry fire session that closely simulates live fire. Thus, exemplary embodiments discussed herein provide for a simple, low-cost, critical associative training for the AR-platform to create safe and proficient operators in the military, law enforcement, competition, and home defense communities.

FIG. 1 is a cross-section of a conventional AR-platform rifle 100 (e.g., an AR-15, M-4, and M-16, hereinafter referred to as an AR-15 rifle 100) illustrating the main internal components. As illustrated in FIG. 1, with a loaded magazine 109 (comprising a spring and follower) inserted into the AR-15 rifle's magazine well (an opening in the bottom of the AR-15 rifle's lower receiver 204), the AR-15 rifle is ready for use. The magazine 109 is loaded with "rounds," each including a bullet that is fitted to a casing filled with a powder. An operator can now pull back the AR-15 rifle's charging handle (not shown), which causes a bolt carrier group (BCG) 101 to retract along with the charging handle against a recoil spring 114. Releasing the charging handle allows the bolt carrier group 101 to return. As the bolt carrier group 101 returns, it removes a round from the magazine 109 and inserts it into the AR-15 rifle's chamber 107.

When the safety selector switch 302 (see FIGS. 1 and 3) is rotated from "safe" to "fire," pulling the trigger 221 causes a hammer 225 to be freed from a sear 222, allowing the hammer 225 to strike a firing pin 102. When the firing pin 102 is struck by the hammer 225, the firing pin 102 is driven forward to strike the rear of the bullet seated in the chamber 107. Struck by the firing pin 102, the powder in the casing ignites, propelling the bullet down the barrel 106 (illustrated with an optional muzzle device 105). Some of the gas pressure from the burning powder is diverted through a gas block 104 to be returned to the bolt carrier group 101 (via a gas tube 103). As illustrated in FIG. 1, the gas tube 103 and barrel 106 are enclosed within a barrel shroud or handgrip 108.

The gas pressure against the BCG 101 causes the BCG 101 (and buffer 113) to slide back into a buffer tube 115 and against a recoil spring 114. The recoil spring 114 and buffer tube 115 are contained within the AR-15 rifle's buttstock 116. As the BCG 101 slides back into the buffer tube 115, the spent casing is ejected from the chamber 107 and the hammer 225 is locked (as described herein). As the gas pressure via the gas tube abates, the recoil spring 114 returns the BCG 101 forward. Similar to the first time when the charging handle was used to chamber a first round, as the BCG 101 returns, another round is removed from the magazine 109 and inserted into the chamber 107. When the trigger is released, the trigger 225 resets onto the sear 222 and the AR-15 rifle 100 is ready to fire again.

Figure 2:
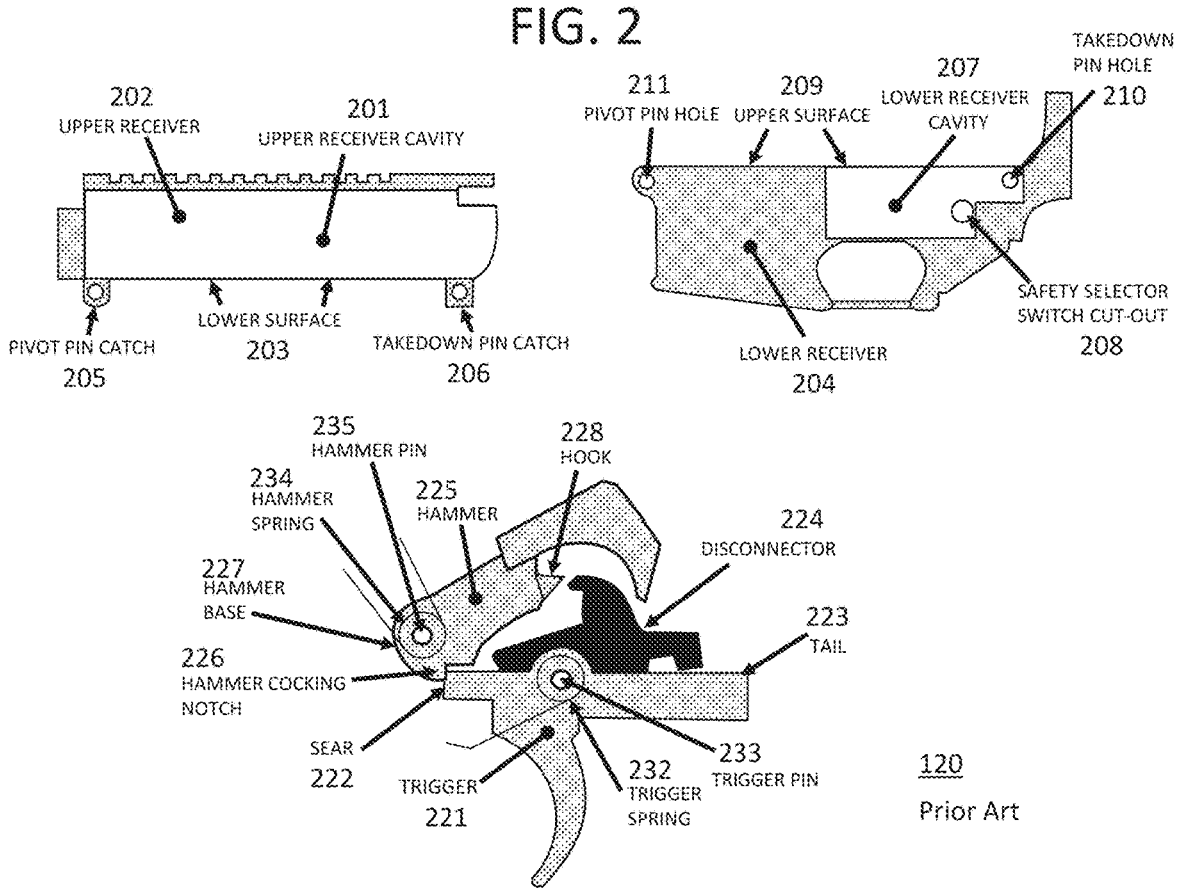
FIG. 2 is a left-side view of selected portions of the AR-platform rifle of FIG. 1.

FIG. 2 provides a detailed breakdown of a few of the components of the AR-15 rifle 100. As also illustrated in FIGS. 1 and 2, and discussed in detail herein, the BCG 101 slides within a portion of an upper receiver 202. The upper receiver includes the BCG 101, the chamber 107, and the barrel 106. As illustrated in FIG. 1, the firing pin 102 is located within the BCG 101. When the upper receiver 202 is closed over the lower receiver 204, a lower surface 203 of the upper receiver 202 lies flush against an upper surface 209 of the lower receiver 204. FIG. 2 also includes a detailed breakdown of the trigger assembly 120, which is retained within a cavity 207 of the lower receiver (also referred to as a lower receiver cutout). The upper receiver 202 is coupled to the lower receiver 204 via a pair of pins. As illustrated in FIG. 2, a pivot pin is installed through a pivot pin hole 211 in the lower receiver 204 and inserted into a pivot pin catch 205 in the upper receiver. When the pivot pin is installed, the upper receiver 202 is free to rotate or "pivot" about the pivot pin with respect to the lower receiver 204. A rear takedown pin is installed through a hole 210 in the lower receiver 204 and inserted into a takedown pin catch 206 in the upper receiver 202.

The trigger assembly 120 includes a trigger 221, a hammer 225, a disconnector 224, a trigger spring 232, and a trigger pin 233 (see FIG. 2). The trigger 221 includes a sear 222 and a tail 223, which are portions of the trigger 221 that extend forward and rearward, respectively, from a pivot axis of the trigger 221 (see FIGS. 3A and 3C). The hammer 225 includes a hammer cocking notch 226 (also referred to as a sear notch), a hammer base 227, a hammer spring 234, and a hook 228 (see FIG. 2). The hammer 225 pivots around a pivot axis which is encircled by the hammer spring 234. The hammer spring 234 is held in place by the hammer 225, which, in turn, is held in place with a hammer pin 235 (see FIG. 2). The hammer 225 pivots around an axis defined by the hammer pin 235. When the BCG 101 is driven back by the residual pressure from a fired round (see FIG. 1), the hammer 225 is rotated back and the hook 228 is captured by the disconnector 224 until the trigger 221 is released. When the trigger 221 is released, the disconnector 224 releases the hook 228 and the hammer 225 is reset and ready to fire again.

Figure 3A:
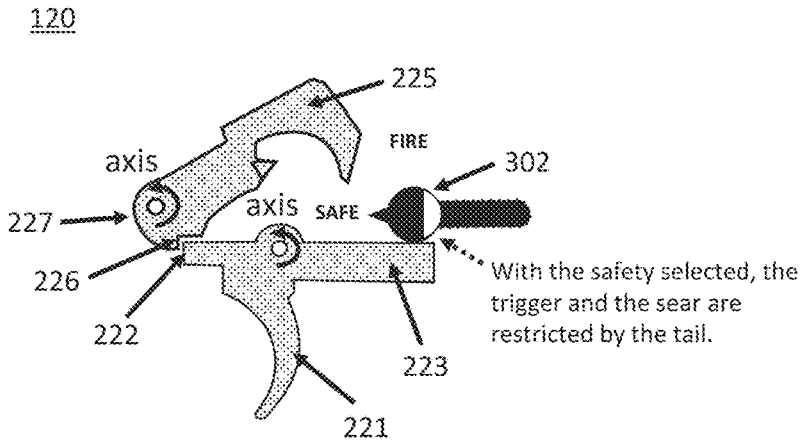
FIGS. 3A-3D is a series of side and rear views of the trigger assembly of the AR-platform rifle of FIG. 1 illustrating the operation of the safety selector switch.
Figure 3B:
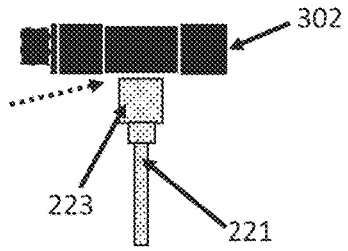
Figure 3C:
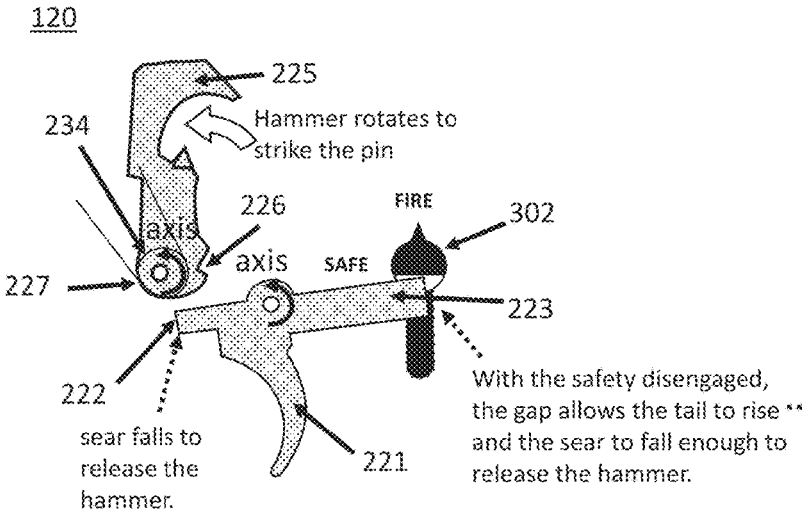
Figure 3D:
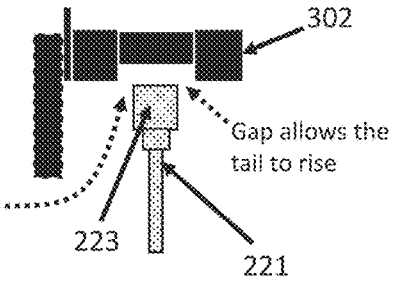

FIGS. 3A-3D illustrate the operation of the safety selector switch 302. In FIG. 3A, the safety selector switch 302 is on "safe." FIG. 3A also illustrates that when "safe" is selected, the trigger 221 and sear 222 are restricted by the trigger's tail 223, which is impacting the rounded portion of the safety selector switch 302 and unable to move enough to release the hammer 225 (compare FIGS. 3B and 3D). FIG. 3B is a rear view of the safety selector switch 302 and the way it restricts the trigger 221 when the tail 223 is held down by the rounded portion of the safety selector switch 302. As illustrated in FIGS. 3C and 3D, the safety selector switch's rounded portion has a flat side that when rotated, e.g., when the safety selector switch 302 is on "fire," a gap between the tail 223 and the safety selector switch 302 allows the tail 223 to rise (when the trigger 221 is pulled) and the sear 222 to fall (rotate down) enough to release the hammer 225. Thus, the safety selector switch 302 restricts the movement of the sear 222 and the trigger 221.

FIGS. 4A-4E illustrate an issue encountered when "dry firing" the AR-platform. As discussed herein, dry firing is a training technique where an operator trains with an AR-platform rifle, such as, going through the conventional motions of properly handling and positioning of the rifle, acquiring a target and aligning the rifle's sights on the target, switching the safety selector switch 302 to "fire," pulling the trigger 221 when ready to fire, and then switching the safety selector switch 302 back to "safe." These sorts of steps are the same whether training with live ammunition or training without ammunition or with "dummy rounds," aka, "dry firing." However, unlike most semi-automatic rifles, the AR-platform rifle's safety selector switch 302 locks both the trigger 221 and the sear 222 (see FIG. 4C). FIGS. 4B and 4C illustrate that, during dry fire training, once the trigger 221 is pulled, the safety selector switch 302 will lock the rifle in the "fire" position until the hammer 225 is re-cocked. In other words, as illustrated in FIG. 4C, the operator is unable to rotate the safety selector switch 302 to "safe."

Consequently, while "dry firing" any of the AR-platform rifles, proper safety selector switch 302 practice is more difficult. Normally, pulling the trigger 221 releases the hammer 225 to strike the firing pin 102 and fire the rifle (which normally cycles the BCG 101 and trigger assembly 120, also known as "cycling the rifle's action"). When "dry firing," the AR-platform rifle 100 is not fired (because either there are no rounds loaded or the operator is using "dummy rounds") and the rifle action is not cycled. The hammer 225 is held in the forward position against the firing pin 102 (see FIG. 4B), causing the trigger assembly 120 to be retained in the position illustrated in FIG. 4C. The trigger assembly 120 is unable reset and locks the safety selector switch 302 in the "fire" position (see FIG. 4C).

Thus, instead of keeping the rifle on the target and thumbing the safety selector switch 302 from "fire" to "safe" (as is the normal procedure when performing "live fire" practice), during "dry fire" training, the operator must pause in their training after each pull of the trigger 221 to manually reset the hammer 225 to use the safety selector switch 302 again. Manually resetting the hammer 225 is accomplished by pulling back on the charging handle. Pulling the charging handle back pulls the BCG 101 back (against the recoil spring 114) and rotates the hammer 225 back into the "cocked" position and resets the trigger assembly 120 (see FIGS. 4D and 4E). As discussed herein, after pulling back the charging handle, the charging handle is released, allowing the BCG 101 to return to its "locked" position up against the chamber/barrel 107,106. As illustrated in FIG. 4E, when the trigger assembly 120 is reset, the tail 223 is lowered out of the way of the safety selector switch 302. Lowering the tail 223 frees the safety selector switch 302 to rotate. This allows the operator to rotate the safety selector switch 302 and return the AR-15 rifle 100 to "safe" (see FIG. 4E).

Figure 6:
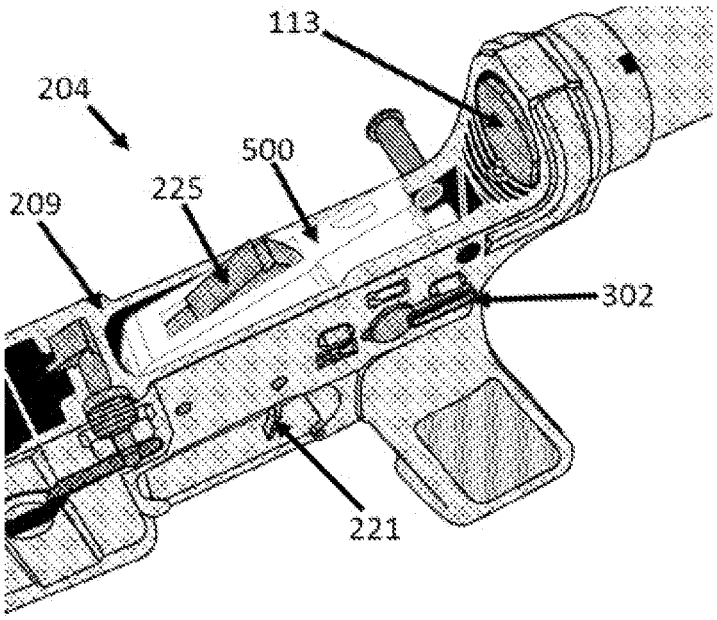
FIG. 6 is a perspective view of the safety device of FIG. 5 inserted into the lower receiver of an AR-platform rifle in accordance with an embodiment of the present invention.

Embodiments of an exemplary safety block 500 allow an operator to freely operate the safety selector switch 302 during dry fire practice. The safety block 500 is installed into the AR-15 rifle 100 by opening the AR-15 rifle 100 (removing the rear takedown pin and rotating the upper receiver 202 about the pivot pin to rotate the upper receiver 202 away from the lower receiver 204 and expose the interior of the lower receiver 204), inserting the safety block 500 into the lower receiver cavity 207, and then closing the AR-15 rifle 100. FIG. 6 illustrates the upper receiver 202 rotated away from the lower receiver 204 and exposing the interior of the lower receiver 204. FIG. 6 also illustrates the placement of the safety block 500. The safety block 500, when installed into an AR-15 rifle 100, does not interfere with the mechanical operation of the AR-platform rifle 100 and allows the use of dummy rounds during dry fire sessions. Embodiments of the exemplary safety block 500 solve the problem of the operator having to "re-charge" (recycle the trigger mechanism 120) the AR-platform rifle 100 during practice, which will greatly enhance training by allowing the incorporation of proper safety selector switch 302 operation during dry fire training sessions.

Figure 5:
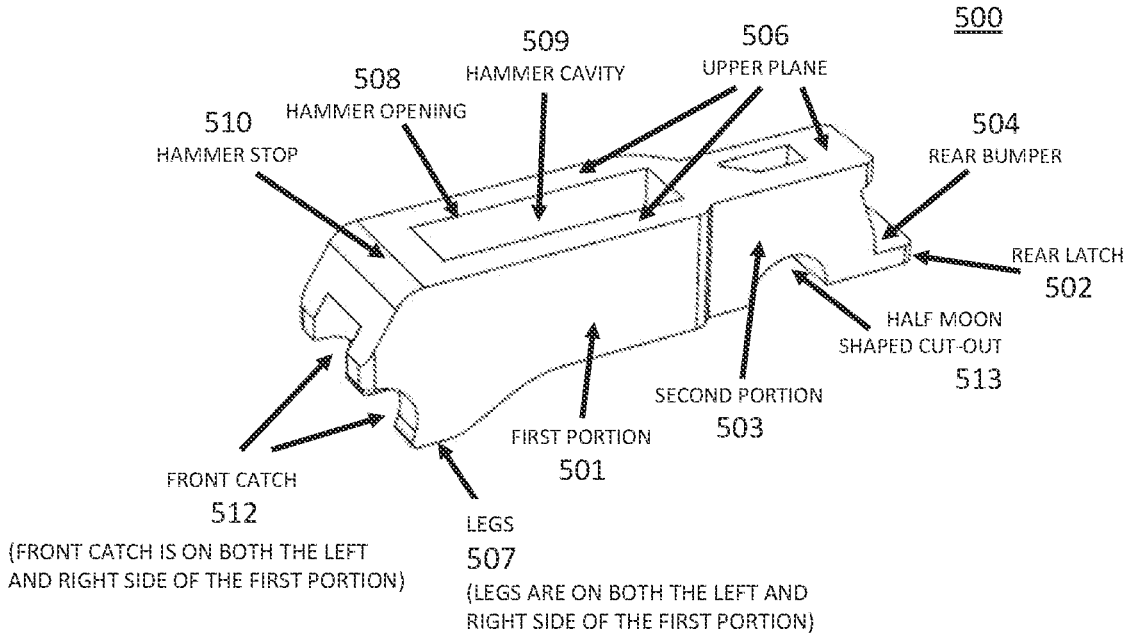
FIG. 5 is a perspective view of a safety device configured for insertion into the lower receiver of an AR-platform rifle in accordance with an embodiment of the present invention.
Figure 7A:
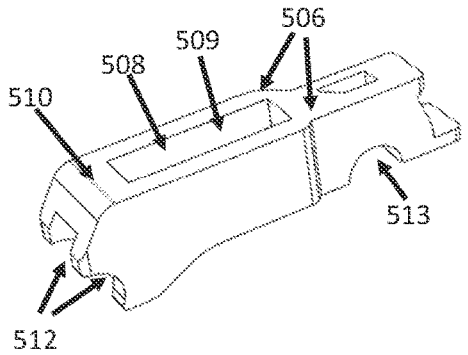
FIGS. 7A-7F are perspective views of the safety device of FIG. 5 illustrating the sides, top, and under sides of the safety device.
Figure 7B:
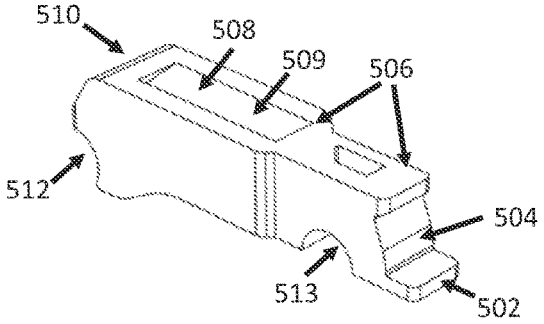
Figure 7C:
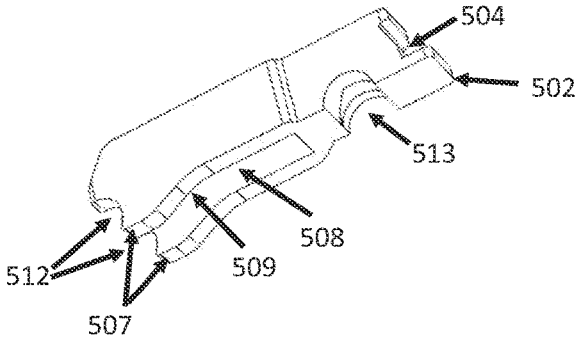
Figure 7D:
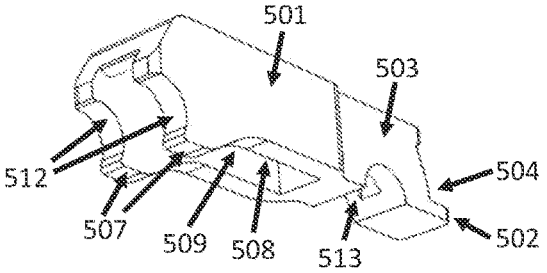
Figure 7E:
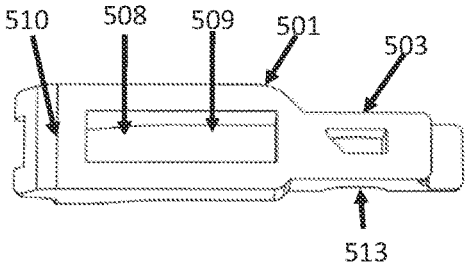
Figure 7F:
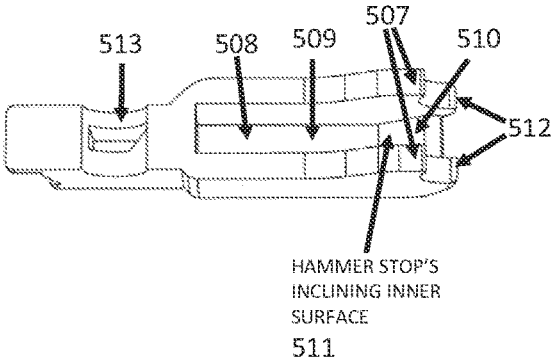
Figure 7G:
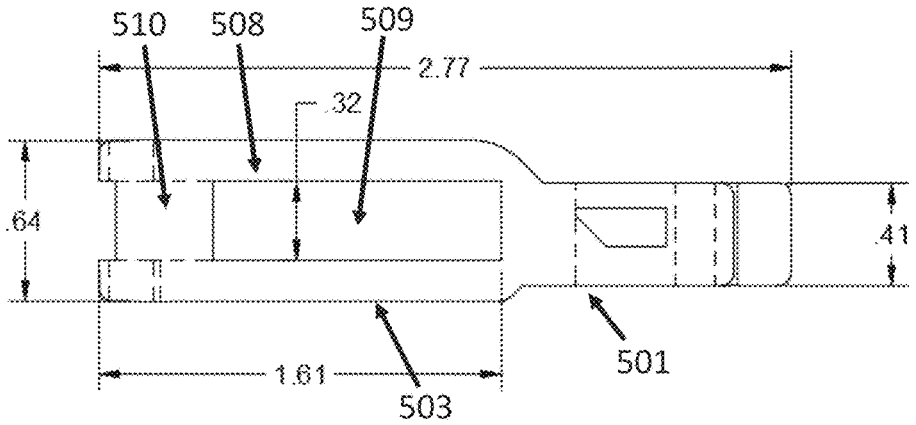
FIGS. 7G-7I are top, side, and rear views of a line drawing of the safety device of FIG. 5 in accordance with an embodiment of the present invention.
Figure 7H:
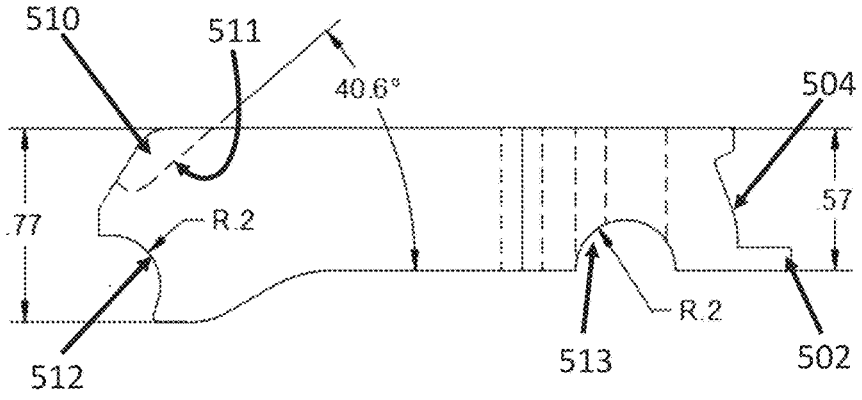
Figure 7I:
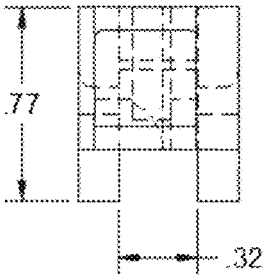

FIG. 5 is a perspective view of an embodiment of the safety block 500. The safety block 500 includes a first portion 501 having a width that is greater than a second portion 503, where in the illustrated embodiment the width of the first portion 501 is 0.64 inches and the width of the second portion 503 is 0.41 inches (see FIGS. 5 and 7G). The first and second portions 501, 503 include differing widths to conform to the differing widths of the lower receiver cavity 207 (see FIGS. 13A-13C). The safety block 500 incorporates a hammer opening 508. As illustrated in FIGS. 7A-7F, the hammer opening 508 opens into a hammer cavity 509, which is defined by a pair of legs 507 (see FIGS. 7A-7F), where the legs 507 define the sides of the safety block 500. This hammer cavity 509 extends through a first portion 501 of the safety block 500 and is configured to receive the hammer 225 (see FIGS. 6 and 7A-7F). As illustrated in FIGS. 8B and 8D, an upper portion of the hammer 225 passes through the hammer cavity 509 and the hammer opening 508 and into the upper receiver cavity 201. An upper surface 506 of the safety block 500 defines a flat, level plane on the safety block 500 that comes in contact with a lower surface 203 of the upper receiver 202 (when the upper receiver 202 is closed). As illustrated in FIGS. 8A-8D, when the upper receiver 202 is closed over the safety block 500 and latches with the lower receiver 204, the safety block 500 is pushed by the upper receiver 202 into a desired position. A forward or front portion of the first portion 501 of the safety block 500 forms a hammer stop 510 and is configured to have a specially shaped incline inner surface 511 (see FIGS. 7E-7I) inside the hammer cavity 509. The hammer stop's inclining inner surface 511 is selected to reposition (rotate) the hammer 225 away from the sear 222 when the safety block 500 is installed. A pair of arc-shaped extensions from each of the legs 507 forms a front catch 512. A rear portion of the second portion 503 of the safety block 500 forms a rear bumper 504, with a further tab, or extension, or rear latch 502 extending outwardly from the bottom of the rear bumper 504 (see FIGS. 5 and 7A-7I). The rear bumper 504 of the safety block 500 rests against the takedown pin catch 206 of the upper receiver 202, while the front catch 512 (which rests against the hammer pin 235 and hammer spring 234), aligns and secures the safety block 500 from front to back to ensure proper positioning of the hammer stop 510 and the hammer opening 508 and hammer cavity 509 with respect to the hammer 225 and the rest of the trigger assembly 120 (see FIGS. 8B and 8D). Lastly, the rear latch 502 (under, and extending from, the rear bumper 504) rests under and against the upper receiver takedown pin catch 206. As illustrated in FIGS. 8B and 8D, when the safety block 500 is in position, a half-moon shaped cutout 513 on the bottom surface of the safety block 500 rests upon the safety selector switch 302.

Figure 13A:
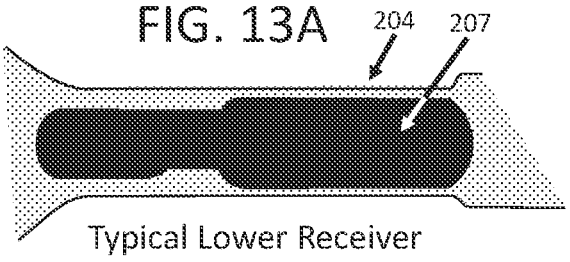
FIGS. 13A-13C are top-down views of an exemplary AR-platform lower receiver illustrating the exemplary cut outs for trigger assemblies.
Figure 13B:
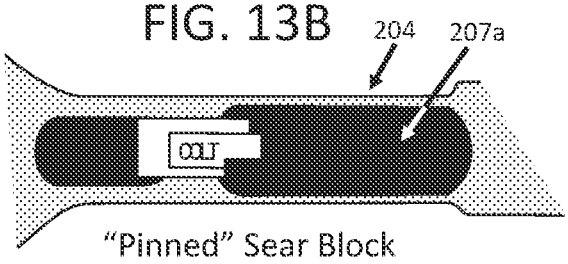
Figure 13C:
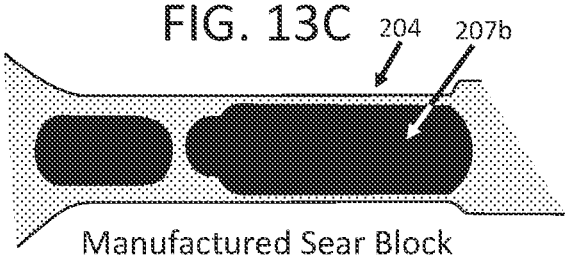
Figure 14A:
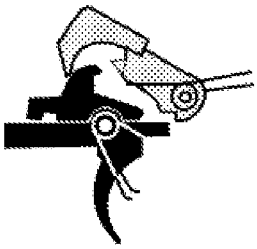
FIGS. 14A-14D are side views of exemplary trigger assembly embodiments.
Figure 14B:
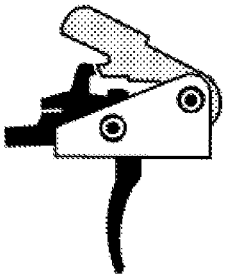
Figure 14C:
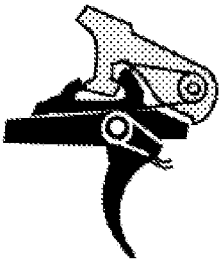
Figure 14D:
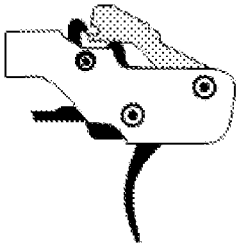

With reference to FIGS. 2, 5, 6, 7A-7I, and 8A-8D, the safety block 500 is locked into place from front to back with the front catch 512 contacting the hammer spring 234 and hammer pin, and the rear bumper 504 and rear latch 502 resting next to, and under, the takedown pin catch 206, respectively. The width of the safety block 500 (e.g., 0.64 inches at the widest point) allows the safety block 500 to fit "snugly" inside the lower receiver cavity 207 preventing movement from side to side (see FIG. 7G). As discussed herein, the safety block 500 includes a first portion 501 with a width of 0.64 inches and a second portion 503 with a width of 0.41 inches to match the varying interior dimensions of the lower receiver cavity 207. FIGS. 13A-13C illustrate three exemplary lower receiver cavities (cutouts) 207, each with varying interior dimensions. The upper surface 506 and the hammer stop 510 lock the safety block 500 into place from top to bottom (when the upper receiver 202 is closed) (see FIGS. 7A, 7B, 7E, 7F, and 8A-8D). When the operator first places the safety block 500 into the lower receiver 204, the inclining inner surface 511 of the hammer stop 510 comes to rest on an upper surface of the hammer 225 (see FIGS. 2, 5, 8A, and 8C). The upper surface 506 of the safety block 500 protrudes slightly above the top of the lower receiver 204 (see FIGS. 6, 8A, and 8C). The upper receiver cavity 201 of the upper receiver 202 is narrower than the lower receiver cavity 207 (see FIG. 2 and FIG. 15B). As the upper receiver 202 closes over the lower receiver 204 and the safety block 500, the lower surface 203 of the upper receiver 202 contacts the upper surface 506 of the safety block 500, this results in the hammer stop 510 of the safety device 500 pushing (rotating) the hammer 225 down, breaking contact with the sear 222. With the upper receiver 202 fully closed over the lower receiver 204, and the rear takedown pin locked into place, the upper surface 506 of the safety block 500 is aligned with the upper surface 209 of the lower receiver 204. This aligns the inclining inner surface 511 of the hammer stop 510 against the upper surface of the hammer 225, rotationally pushing the hammer 225 back. Note that when the hammer stop 510 is pushing against the hammer 225, a portion of the hammer 225 extends through the hammer cavity 509 and the hammer opening 508 to extend into the upper receiver cavity 201 of the upper receiver 202 (see FIGS. 8B and 8D). The hammer stop 510 is shaped at a selected incline inner surface 511 inside the hammer cavity 509 so that when the safety block 500 is locked into place, the hammer cocking notch 226 and sear 222 are no longer in contact (because the hammer 225 is held in a position such that the hammer cocking notch 226 is freed from the sear 222). The trigger 221 can now be pulled and released without the safety selector switch 302 being locked in the "fire" position. When the safety selector switch 302 is on "safe," the trigger 221 still cannot be pulled (because movement of the tail 223 is restricted by the safety selector switch 302). The operator can now engage and disengage the safety selector switch 302 at any time during dry fire training without the need to re-cock the hammer 225 and the rest of the trigger assembly 120.

Figure 15A:
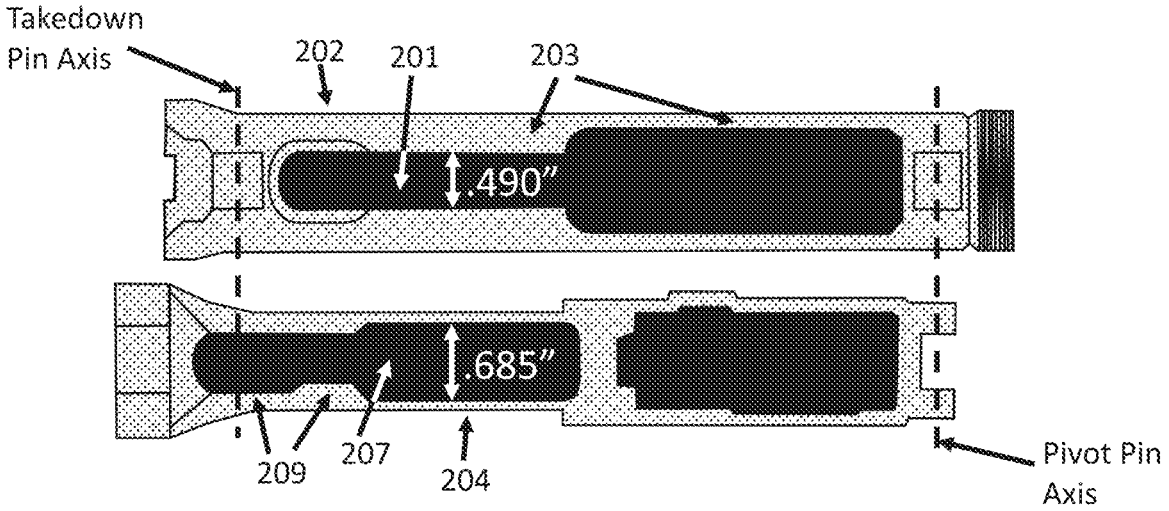
FIGS. 15A-15C are top and bottom views of the lower and upper receivers, respectively, illustrating the difference in width between the receivers.
Figure 15B:
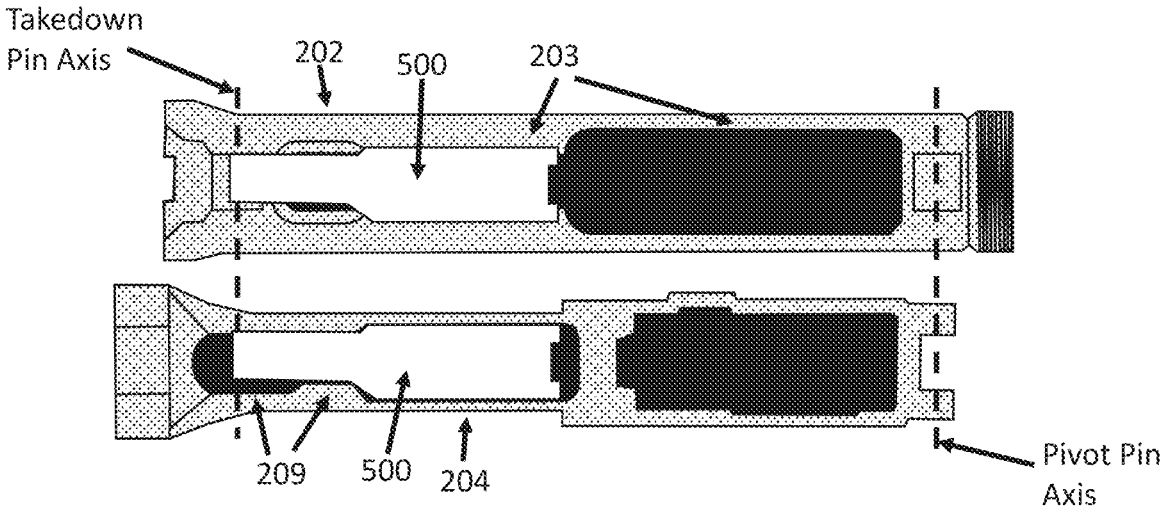

FIG. 15A illustrates the difference between the narrower upper receiver opening and the wider lower receiver opening. This is a key component in the design of the safety block 500. FIG. 15B compares the outline of the safety block 500 to the openings of the upper and lower receivers 202, 204. As illustrated in FIGS. 8A-8D and 15B, the embodiment of the safety block 500 is too wide to fit inside the upper receiver cavity 201 so, as the upper receiver 202 is closed, it seats the safety block into place inside the lower receiver cavity 207. The lower surface 203 of the upper receiver 202 directly contacts the upper surface 506 of the safety block 500. Because the safety block 500 fits snugly inside the lower receiver cavity 207, the upper receiver 202 pushes the safety block 500 fully into place, seating the hammer stop 510 against the hammer 225 and positioning the hammer 225 away from the sear 222.

With the hammer cocking notch 226 of the hammer 225 freed from the sear 222 (and restrained by the hammer stop 510 in its "cocked" position), the trigger 221 can be pulled repeatedly and the safety selector switch 302 rotated between "fire" and "safe" without having to re-set the hammer 225 and the rest of the trigger assembly 120 (between trigger pulls). With the safety block 500 installed, the safety block 500 remains clear of the trigger assembly 120 so that the operator is free to incorporate dummy rounds into a dry fire session for an even closer simulation of live fire.

The safety block 500 gives the trigger 221 a distinctive feel (because the hammer 225 has been freed from the sear 222 and restrained by the hammer stop 510 in its "cocked" position). When the safety selector switch 302 is set to "safe," the travel (rotation) of the trigger 221 is restricted. This trigger restriction is similar with and without the safety block 500. When the safety selector switch 302 is set to "fire," travel of the trigger 221 is unrestricted similar to the effect with and without the safety block 500. However, the trigger 221 will not "break" with the safety block 500 installed. The trigger break is normally that moment of pull when the pull of the trigger 221 will rotate the sear 222 away from the hammer's cocking notch 226 (see FIGS. 3C, 4A, and 4B) and releases the hammer 225 to be rotated forward. The lack of a trigger break is a noticeable difference in the feel of the AR-15 rifle's operation and can also serve to indicate to the operator that the safety block 500 is installed. While the feel is different from normal operation, it is still quite similar to normal operation enough so that a realistic training experience is maintained. As discussed herein, when the safety block 500 is installed, the AR-15 rifle 100 will not fire live ammunition. Thus, when on the range and desiring to fire live ammunition, the operator removes the magazine, clears the AR-15 rifle 100, removes the safety block 500, and resumes normal operations.

Figure 9:
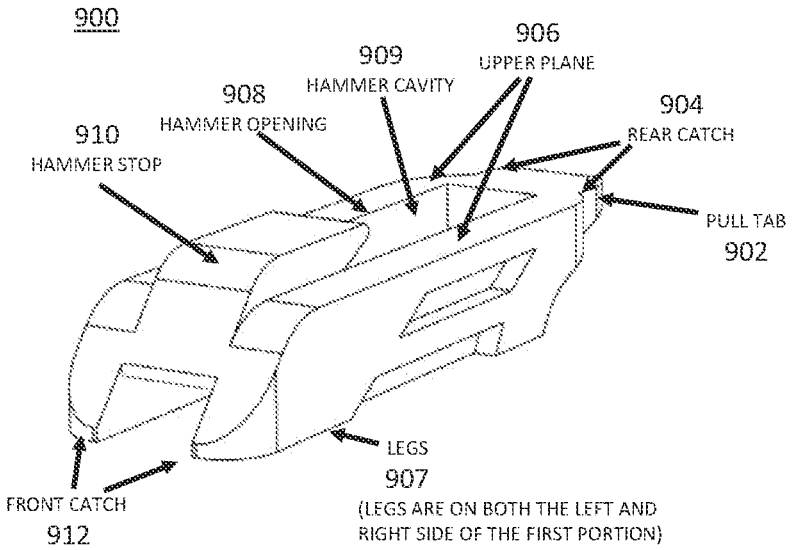
FIG. 9 is a perspective view of an alternative safety device configured for insertion into the lower receiver of an AR-platform rifle in accordance with an embodiment of the present invention.
Figure 10:
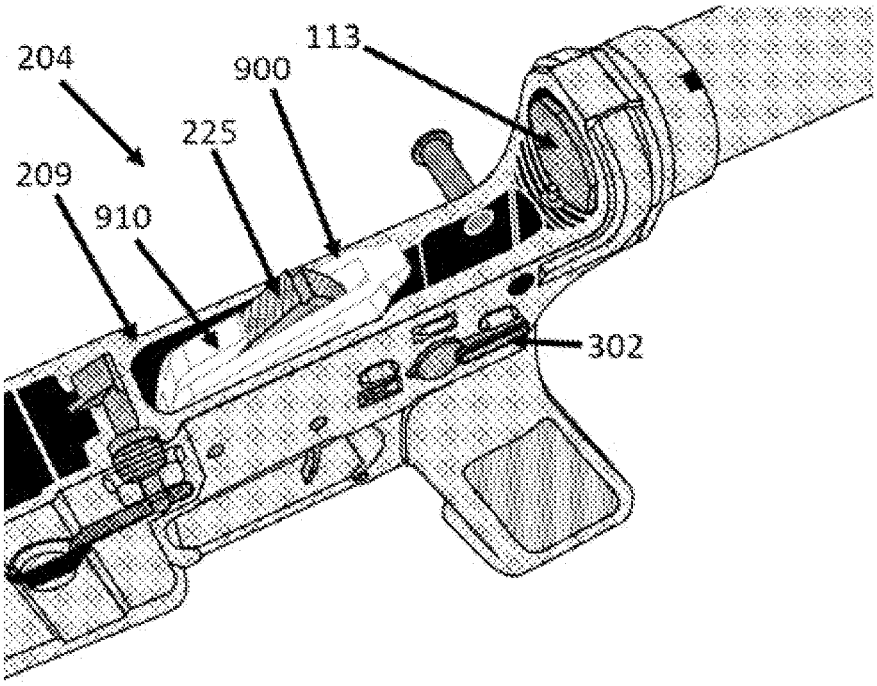
FIG. 10 is a perspective view of the alternative safety device of FIG. 9 inserted into the lower receiver of an AR-platform rifle in accordance with an embodiment of the present invention.
Figure 11A:
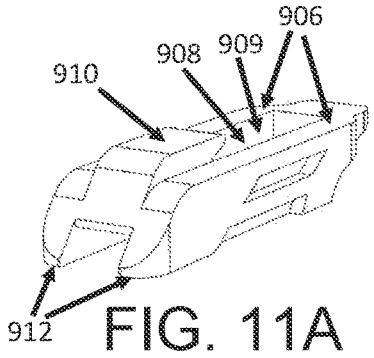
FIGS. 11A-11E are perspective views of the alternative safety device of FIG. 9 illustrating the sides, top, and under sides of the alternative safety device.
Figure 11B:
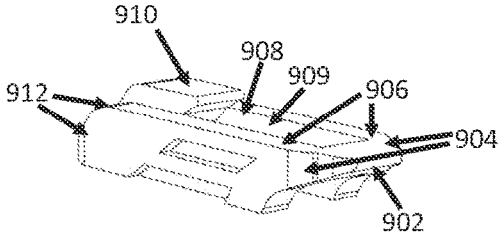
Figure 11C:
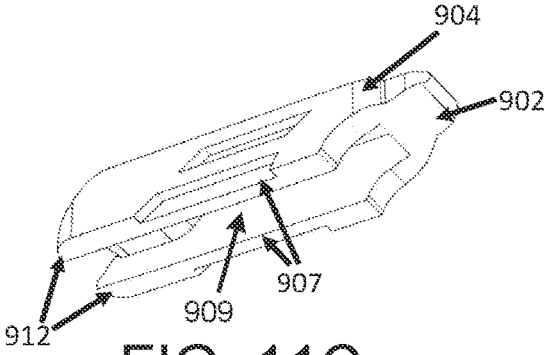
Figure 11D:
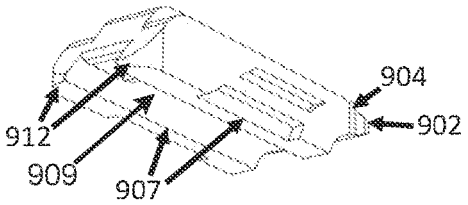
Figure 11E:
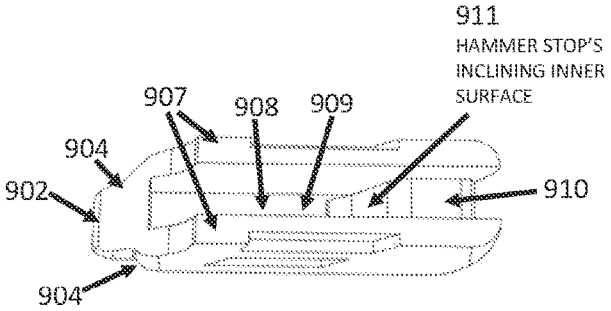

FIG. 9 is a perspective view of an alternative safety block 900. Unlike the first safety block 500, the alternative safety block 900 is formed with a single width (0.65 inches). The alternative safety block 900 incorporates a hammer opening 908, which opens into a hammer cavity 909, which is defined by a pair of legs 907 (see FIGS. 11C-11E). The hammer cavity 909 extends through a central portion of the safety block 900 (see FIG. 11E). The hammer opening 908 and hammer cavity 909 provide an opening for the hammer 225 to slide through (see FIG. 10). The hammer opening 908 and hammer cavity 909 are similar to the hammer opening 508 and hammer cavity 509 of the original safety block 500 described herein. An upper surface 906 of the safety block 900 defines a flat, level plane on the top of the safety block 900 that contacts with the upper receiver 202.

The safety block 900 is installed into the AR-15 rifle 100 in the same manner as described for the safety block 500. That is, the AR-15 rifle 100 is opened (i.e., removing the rear takedown pin and rotating the upper receiver 202 about the pivot pin to rotate the upper receiver 202 away from the lower receiver 204 and to expose the interior of the lower receiver 204), inserting the safety block 900 into the lower receiver cavity 207, and then reclosing the AR-15 rifle 100. As illustrated in FIGS. 12A-12D, when the upper receiver 202 is closed over the safety block 900 and latches with the lower receiver 204, the safety block 900 is pushed into a desired position.

Figure 11F:
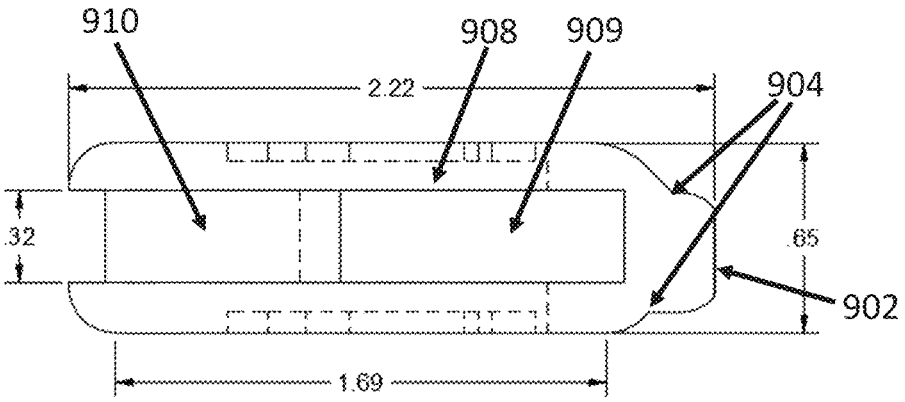
FIGS. 11F-11H are top, side, and rear views of a line drawing of the alternative safety device of FIG. 9 in accordance with an embodiment of the present invention.
Figure 11G:
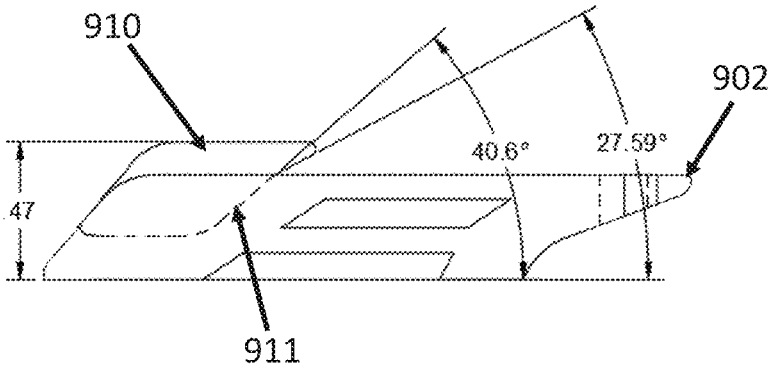
Figure 11H:
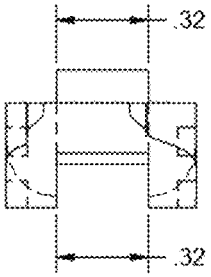

A hammer stop 910 of the safety block 900 includes a specially shaped inclining inner surface 911 (see FIGS. 11B, 11E, and 11G) inside the hammer cavity 909 that positions (rotates) the hammer 225 away from the sear 222. The hammer stop 910 of the safety block 900 (see FIGS. 9, 11B, 11G, and 12D) is more substantial than the hammer stop 510 of the original safety block (see FIGS. 7A, 7H, and 8D). A rearward portion of the safety block 900, along the upper surface 906, forms a rear catch 904, with a portion projecting from the rear catch forming a pull tab 902. On the opposite end of the safety block 900, a pair of projections from the bottoms of the legs 907 form a front catch 912. The front catch 912 is below and projecting away from the hammer stop 910. The rear catch 904 and front catch 912 work together to align and secure the safety block 900 from front to back within the lower receiver cavity 207 and ensure proper positioning of the hammer stop 910 and the hammer opening 908 (and hammer cavity 909) with respect to the hammer 225 and the rest of the trigger assembly 120 (see FIGS. 10, 12D, and 12A-12D). Lastly, the pull tab 902 extending away from the rear catch 904 provides a surface for an operator to grab onto with a thumb and finger to allow for easy installation and removal of the safety block 900.

With reference to FIGS. 2, 9, 10, FIGS. 11A-11H, and FIGS. 12A-12D, the safety block 900 is locked into place within the lower receiver cavity 207 from front to back with the front catch 912 contacting the front of the lower receiver cavity 207 and the rear catch 904 contacting the rear of the forward portion of the lower receiver cavity 207 (see FIGS. 12D and 12E). The width of the safety block 900 (e.g., 0.65 inches) allows it to fit "snugly" inside the lower receiver cavity 207 preventing movement from side to side (see FIG. 11F). FIGS. 13A-13C illustrate three exemplary lower receiver cavities (cutouts) 207. The upper surface 906 and the hammer stop 910 lock the safety block 900 into place from top to bottom (when the upper receiver 202 is closed) (see FIGS. 11A, 11B, 11E, 11G, and 12A-12D). When the operator first places the safety block 900 into the lower receiver 204, the hammer stop's inclining inner surface 911 comes to rest on a top surface of the hammer 225 (see FIGS. 10, 12A-12D). The upper surface 906 of the safety block 900 protrudes slightly above the top of the lower receiver 204 (see FIGS. 10, 12A-12D). The upper receiver cavity 201 is narrower than the lower receiver cavity 207. As the upper receiver 202 closes over the lower receiver 204 and the safety block 900, the upper receiver 202 contacts the upper surface 906 of the safety block 900 and the hammer stop 910 pushes (rotates) the hammer 225 down and breaks contact with the sear 222 (see FIGS. 12A-12D). With the upper receiver 202 fully closed over the lower receiver 204, and the rear takedown pin locked into place, the hammer cocking notch 226 and sear 222 are no longer in contact (with the hammer 225 rotated and held in a position where the hammer cocking notch 226 is freed from the sear 222).

The trigger 221 can now be pulled and released without the safety selector switch 302 being locked in the "fire" position. When the safety selector switch 302 is on "safe," the trigger 221 still cannot be pulled. The operator can now engage and disengage the safety selector switch 302 at any time during dry fire training without the need to re-cock the hammer 225 and the rest of the trigger assembly 120.

Similar to the feel of the safety block 500, the alternative safety block 900 also gives the trigger 221 a distinctive feel (because the hammer 225 has been freed from the sear 222 and restrained by the hammer stop 910 in its "cocked" position). When the safety selector switch 302 is set to "safe," the travel of the trigger 221 is restricted. This trigger restriction is similar with and without the safety block 900. While the feel is different from normal operation, it is still quite similar to normal operation enough so that a realistic training experience is maintained. As discussed herein, when the safety block 900 is installed, the AR-15 rifle 100 will not fire live ammunition. Thus, when on the range and desiring to fire live ammunition, the operator removes the magazine, clears the AR-15 rifle 100, removes the safety block 900, and resumes normal operations.

Figure 15C:
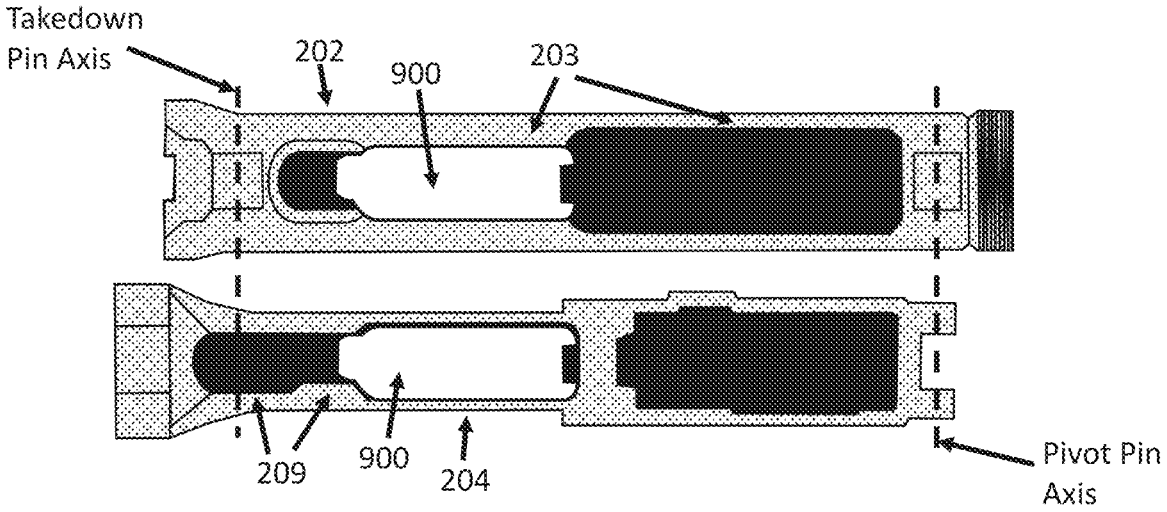

FIG. 15C compares the outline of the safety block 900 to the openings of the upper and lower receivers (see FIG. 15A). As illustrated in FIG. 15C, the embodiment of the safety block 900 is too wide to fit inside the upper receiver cavity 201 so, as the upper receiver 202 is closed, it seats the safety block into place inside the lower receiver cavity 207. The lower surface 203 of the upper receiver directly contacts the upper plane 906 of the safety block 900. Because the safety block 900 fits snugly inside the lower receiver cavity 207 the upper receiver 202 pushes the safety block 900 fully into place, seating the hammer stop 910 against the hammer 225 and positioning the hammer 225 away from the sear 222.

The exemplary safety blocks 500, 900 are designed for training purposes. For example, during dry fire training sessions, with or without inert ammunition (dummy rounds), the operator can manipulate the controls of the AR-platform rifle 100 (especially the safety selector switch 302) as they would during conventional live fire range sessions or "real world" situations. Thus, the exemplary safety blocks 500, 900 enhance the realism of dry fire drills by including, but not limited to: allowing the operator to find their natural point of aim; acquire targets from low-ready/high-ready, shooting in the standing position, on one knee, prone, supine, one-handed, covered, and disadvantaged positions; and shooting while moving. The dry fire drills may also include magazine changes, combat/tactical/one-handed reloads, and malfunctions. Such malfunctions can include failure to feed, failure to go to battery, stove pipe, double feed, and bolt override. Additional dry fire drills include transitions to positions and firearms/hands, shooting, scanning, and securing scenes, clearing rooms/structures, team/squad training, and control manipulation with and without dummy rounds. By allowing the operator to manipulate the safety selector switch 302 freely, realism is enhanced in all dry fire training scenarios listed above and more.

The exemplary embodiments of the safety blocks 500, 900 are manufactured using ABS plastics. The safety blocks 500, 900 may be fabricated using 3D printing technologies and molding techniques (e.g., blow molding, rotational molding, extrusion molding, injection molding, and vacuum molding, each with or without machining).

During testing of the safety blocks 500, 900, a fully functioning test platform based on an AR-15 rifle was assembled. It was equipped with a permanently removed barrel (with only a portion of the chamber remaining) and a modified (cut) firing pin. This platform had all of the mechanics of a working AR-platform rifle but without a barrel, and without a working firing pin, it would never fire. The test platform (TP) was assembled of mil-standard materials, making the TP mechanically identical to a vast majority of AR-platform rifles. Thus, if the safety blocks 500, 900 worked on the TP, they would work on nearly all AR-platform rifles. The test platform allowed for testing to ensure the block worked as expected in as many variables as possible and to ensure that the safety block can withstand the stress of repeated dry fire use. The original upper receiver and lower receiver of the test platform are both Aero Precision, while the trigger assembly was an AR Stoner single stage Mil Spec. For stress testing, the upper receiver and lower receiver were closed together 1000 times in increments of 100.

As illustrated in FIGS. 13A-13C and 14A-14D, there can be variations in the AR-platform. For example, there are dozens of companies that produce their own versions of a mil standard AR-15 lower receiver and upper receiver. All are produced in one of two ways: forged or billet. Forged receivers are hammered into a rough form and the fine details are machined. They are easier to produce, generally closer to spec and very durable. Billet receivers are completely machined and vary more widely in size and shape and appearance. Fortunately, all companies, regardless of the method of production, conform to the "mil standard." This specific set of standards means that every receiver will feature the same basic design and dimensions. Therefore, it is safe to assume that all receivers are the same regardless of the company and the manufacturing process (i.e., they can be interchanged).

One noteworthy variation to the standard lower receiver 204 is the Colt lower receiver. FIG. 13A illustrates a conventional lower receiver 204 with a typical lower receiver cavity 207. Colt receivers features a "sear block." to prevent easy conversion of their AR-15 platform rifles from semi-automatic to automatic (see FIGS. 13B and 13C). There are two variations of this sear block. The earlier version features a "pinned sear block" that was installed into previously manufactured lower receivers as a post-production modification (see FIG. 13B). The pinned sear block occupies too much of the lower receiver's cavity 207*a* and the safety blocks (500 and 900) are not compatible. The later version of the sear block was incorporated into Colt's design and manufacturing process (see FIG. 13C). This version's lower receiver cavity 207*b* leaves enough room to accommodate the embodiment of safety block 900 but not enough room to accommodate the embodiment of safety block 500.

As illustrated in FIGS. 14A through 14D, the widest variation of components within lower receivers is in the trigger assembly. There are dozens of trigger assemblies on the market designed to replace the mil standard trigger assembly. Variations include single stage, two stage, standard and drop-in. During development, several products on the market were tested to cover as many variations as possible. While there are variations in the trigger assemblies, all the trigger assemblies work nearly universally with AR-platform lower receivers because the trigger assemblies were all designed to be mil standard. Because all of the trigger assemblies 120 are mil standard, the variations between trigger assemblies are minimized. However, the drop-in trigger assemblies, while conforming to mil standard, have housings that vary significantly.

In addition to the triggers that were tested during the development of the embodiments described herein, many trigger assemblies 120 were researched to determine if they are compatible (would leave enough room in the lower receiver cavity 207 for installation of the different safety block embodiments 500, 900). Generally, the mil standard trigger assemblies 120 have very little variance in their overall outer shape and size (when compared to each other and with the mil standard). Some of the alternative trigger assemblies 120 include "cut outs' within their designs that change the weight, appearance, and/or feel of the trigger pull, but have no impact on the functionality of the trigger assembly 120. During the design phase of the safety blocks 500, 900, a variety of different trigger assembly manufacturers and suppliers were considered, and all mil standard trigger assemblies were compatible with embodiments of the safety block 500, 900. This research noted that "drop-in" trigger assemblies varied more widely (as compared to other more traditional trigger assemblies). However, because all trigger assemblies (regardless of their design) need to fit into mil standard upper and lower receivers, these different trigger assemblies have many more commonalities than differences, especially with regard to the location and the angle of the hammer. The embodiment of the safety block 500 is not compatible with drop-in trigger assemblies. However, the vast majority of drop-in trigger assemblies are compatible with embodiments of the safety block 900 described herein.

While the exemplary embodiments of the safety blocks 500, 900 have been illustrated fitting into AR platform-type rifles, it is understood that embodiments of the safety blocks 500, 900 would be able to serve the same purpose (separating a trigger and sear of a rifle) in other rifle platforms (including AR-variants, e.g., the AR-10 (0.308 version of the AR platform), the 300 Blackout, and the 6.5 Creedmoor, as well as non-AR variants, e.g., the FN SCAR, and the 9 mm PCC). That is, a rifle platform that incorporates a solid trigger/sear assembly and that utilizes upper and lower receivers, allowing access to a lower receiver cavity containing the trigger/sear assembly, may be suitable for use with embodiments of the safety blocks 500,900 without significant modification (inserting a safety block into the lower receiver cavity to separate the trigger from the sear).

Thus, as described herein, embodiments of the safety blocks 500, 900 deliver repeatable quality dry fire training at a fraction of the cost (as compared to commercially available dry fire training systems). Rather than requiring the removal and replacement of conventional AR-15 rifle components, to be replaced by specialty components, the safety blocks 500, 900 are configured for insertion into the AR-15 rifle (between the upper receiver 202 and lower receiver 204). Embodiments of the safety blocks 500, 900 also offer more realistic weapons manipulation with the incorporation of dummy rounds . . . another cost saver. Thus, a low-cost simple alternative that provides additional capability is certainly desirable and commercially viable.

While the foregoing description describes several embodiments of the present invention, it will be understood by those skilled in the art that variations and modifications to these embodiments may be made without departing from the spirit and scope of the invention, as defined in the claims below. The present invention encompasses all combinations of various embodiments or aspects of the invention described herein. It is understood that any and all embodiments of the present invention may be taken in conjunction with any other embodiment to describe additional embodiments of the present invention. Furthermore, any elements of an embodiment may be combined with any and all other elements of any of the embodiments to describe additional embodiments. Changes and modifications in the specifically-described embodiments may be carried out without departing from the principles of the present invention, which is intended to be limited only by the scope of the appended claims as interpreted according to the principles of patent law including the doctrine of equivalents.

The invention claimed is:

1. A safety block configured for insertion into a rifle comprising an upper receiver and a lower receiver, the lower receiver comprising a trigger assembly positioned within a cavity of the lower receiver, the safety block comprising:

a body comprising:

a hammer cavity extending through a central portion of the body from a top surface of the body to a bottom surface of the body; and a hammer stop comprising an inclined inner surface configured to rest against a top surface of a hammer of the trigger assembly when the safety block is inserted into the rifle;

a forward portion formed from the body and configured to contact a forward edge of the lower receiver cavity when the safety block is inserted into the rifle;

a top portion formed from the body and configured to contact a bottom surface of the upper receiver when the safety block is inserted and the upper receiver is closed onto the lower receiver; and a rear portion formed from the body and configured to contact a rear edge of the lower receiver cavity when the safety block is inserted into the rifle;

wherein the body is configured to contact at least two sides of the lower receiver cavity when the safety block is inserted into the rifle; and wherein the hammer stop of the body is configured to rotate forward and push against the hammer when the upper receiver is closed against the lower receiver such that the safety block is forced into the lower receiver cavity, and wherein the hammer stop is configured to rotate the hammer such that the hammer is freed from a restraining portion of the trigger assembly when the safety block is forced into the lower receiver cavity.

2. The safety block of claim 1, wherein the inclined inner surface of the hammer stop of the safety block is configured to contact the hammer at a desired angle such that when the safety block is forced into the lower receiver cavity, the inclined inner surface of the hammer stop is pushed against the hammer and rotates the hammer enough to free the hammer from the restraining portion of the trigger assembly.

3. The safety block of claim 1, wherein the forward portion and the rear portion of the body are configured to hold the body of the safety block securely in position within the cavity with respect to the trigger assembly and the hammer stop.

4. The safety block of claim 1, wherein the rear portion of the body is configured to contact an upper receiver takedown pin catch, and wherein a portion of the rear portion of the body is configured to be in contact with an underside of the upper receiver takedown pin catch when the safety block is forced into the lower receiver cavity by the upper receiver.

5. The safety block of claim 1, wherein the forward portion of the body comprises a pull tab configured to aid in removal of the safety block from the lower receiver when the upper receiver is opened.

6. The safety block of claim 1, wherein the hammer cavity of the body is configured such that the trigger assembly does not contact any portion of the hammer cavity when the safety block is inserted into the rifle.

7. The safety block of claim 6, wherein the hammer cavity of the body is configured such that while the hammer stop of the body holds the hammer in a desired position, other portions of the trigger assembly are free to move without interference from the safety block.

8. The safety block of claim 7, wherein, while the hammer is held in the desired position, pulling back on a trigger of the trigger assembly, which rotates the restraining portion away from the hammer, fails to release the hammer.

9. The safety block of claim 1, wherein, while the hammer is held in the desired position, the safety block is configured such that a safety selector switch of the rifle can be freely rotated from safe to fire positions without interference from the trigger assembly, and wherein pulling back on a trigger of the trigger assembly, which rotates the restraining portion away from the hammer, does not lock the safety selector switch in the fire position.

10. A safety block configured for insertion into a rifle comprising an upper receiver and a lower receiver, the lower receiver comprising a trigger assembly positioned within a cavity of the lower receiver, the safety block comprising:

a body having an upper surface and a lower surface with an opening extending through the body from the upper surface to the lower surface;

wherein the body further comprises a forward portion comprising an angled stop surface configured to rest against a top surface of a hammer of the trigger assembly when the safety block is inserted into the rifle;

wherein the forward portion further comprises a forward catch for engaging a forward edge of the lower receiver cavity when the safety block is inserted into the rifle;

wherein the body further comprises a top portion comprising a top surface that is wider than an upper receiver cavity for engaging the sides of the cavity when the upper receiver is closed onto the safety block;

wherein the body further comprises a rear portion comprising a rear catch for engaging a rear edge of the lower receiver cavity when the safety block is inserted into the rifle; and wherein the angled stop surface of the body is configured to rotate forward and push against the hammer when the safety block is inserted into the rifle and the upper receiver is closed against the lower receiver such that the safety block is forced into the lower receiver cavity, and wherein the angled stop surface is configured to rotate the hammer such that the hammer is freed from a restraining portion of trigger assembly when the safety block is forced into the lower receiver cavity.

11. The safety block of claim 10, wherein the angled stop surface comprises an inclined inner surface configured to rest against the top surface of the hammer, such that when the safety block is forced into the lower receiver cavity, the hammer is rotated and freed from the restraining portion of the trigger assembly.

12. The safety block of claim 10, wherein the safety block is configured to contact at least two sides of the lower receiver cavity when the safety block is inserted into a rifle.

13. The safety block of claim 10, wherein the rear portion comprises a pull tab extending from the rear catch and configured to aid in removing the safety block from the lower receiver cavity.

* * * * *